US007846273B2

(12) United States Patent
Sasaki et al.

(10) Patent No.: US 7,846,273 B2
(45) Date of Patent: Dec. 7, 2010

(54) R-T-B TYPE ALLOY, PRODUCTION METHOD OF R-T-B TYPE ALLOY FLAKE, FINE POWDER FOR R-T-B TYPE RARE EARTH PERMANENT MAGNET, AND R-T-B TYPE RARE EARTH PERMANENT MAGNET

(75) Inventors: Shiro Sasaki, Tokyo (JP); Hiroshi Hasegawa, Tokyo (JP); Kenichiro Nakajima, Tokyo (JP)

(73) Assignee: Showa Denko K.K., Tokyo (JP)

( * ) Notice: Subject to any disclaimer, the term of this patent is extended or adjusted under 35 U.S.C. 154(b) by 692 days.

(21) Appl. No.: 11/589,818

(22) Filed: Oct. 31, 2006

(65) Prior Publication Data

US 2007/0095438 A1 May 3, 2007

Related U.S. Application Data

(60) Provisional application No. 60/734,770, filed on Nov. 9, 2005.

(30) Foreign Application Priority Data

Oct. 31, 2005 (JP) ..... P2005-316551

(51) Int. Cl.

| | |
|---|---|
| ***H01F 1/00*** | (2006.01) |
| ***H01F 1/01*** | (2006.01) |
| ***H01F 1/032*** | (2006.01) |
| ***H01F 1/04*** | (2006.01) |
| ***H01F 1/047*** | (2006.01) |
| ***H01F 1/053*** | (2006.01) |
| ***H01F 1/055*** | (2006.01) |
| ***H01F 1/057*** | (2006.01) |
| ***H01F 1/06*** | (2006.01) |

(52) U.S. Cl. ..... 148/302; 148/300; 148/301; 252/62.55

(58) Field of Classification Search ..... None
See application file for complete search history.

(56) References Cited

U.S. PATENT DOCUMENTS

| | | | | |
|---|---|---|---|---|
| 5,383,978 | A | 1/1995 | Yamamoto et al. | |
| 5,963,774 | A * | 10/1999 | Sasaki et al. | 419/33 |
| 6,328,825 | B1 * | 12/2001 | Hasegawa et al. | 148/541 |
| 6,413,327 | B1 * | 7/2002 | Okajima et al. | 148/301 |
| 6,444,048 | B1 | 9/2002 | Hasegawa et al. | |
| 6,464,931 | B1 * | 10/2002 | Oota et al. | 266/274 |
| 7,442,262 | B2 | 10/2008 | Sasaki | |
| 2007/0266822 | A1 | 11/2007 | Sasaki | |

FOREIGN PATENT DOCUMENTS

| | | | |
|---|---|---|---|
| JP | 5-222488 | A | 8/1993 |
| JP | 2003-188006 | A | 7/2003 |

* cited by examiner

*Primary Examiner*—Melvin C Mayes
*Assistant Examiner*—Colin W Slifka
(74) *Attorney, Agent, or Firm*—Sughrue Mion, PLLC

(57) ABSTRACT

An R-T-B type alloy (wherein R is at least one member selected from rare earth elements, T is a transition metal including Fe, and B includes boron) which is a raw material for use in a rare earth-based permanent magnet, wherein the volume percentage of the region containing an $R_2T_{17}$ phase having an average grain diameter of 3 μm or less in the short axis direction is from 0.5 to 10%.

8 Claims, 2 Drawing Sheets

R-T-B TYPE ALLOY, PRODUCTION METHOD OF R-T-B TYPE ALLOY FLAKE, FINE POWDER FOR R-T-B TYPE RARE EARTH PERMANENT MAGNET, AND R-T-B TYPE RARE EARTH PERMANENT MAGNET

CROSS-REFERENCE TO RELATED APPLICATIONS

This application claims the benefit of U.S. Provisional Application No. 60/734,770, filed Nov. 9, 2005, the content of which is incorporated herein by reference. In addition, the present application claims foreign priority based on Japanese Patent Application No. 2005-316551, filed Oct. 31, 2005, the content of which is incorporated herein by reference.

TECHNICAL FIELD

The present invention relates to an R-T-B type alloy, a production method of an R-T-B type alloy flake, a fine powder for an R-T-B type rare earth permanent magnet, and an R-T-B type rare earth permanent magnet. In particular, the present invention relates to an R-T-B type alloy flake produced by a strip casting method.

BACKGROUND ART

Among permanent magnets, R-T-B type magnets exhibit a high maximum magnetic energy product and are being used for HD (hard disk), MRI (magnetic resonance imaging), various types of motors and the like by virtue of their high-performance characteristics. A recent increase in demand for energy saving, in addition to enhancements in the heat resistance of R-T-B type magnets, has caused the usage rate in motors, including automobile motors, to increase.

R-T-B type magnets may comprise Nd, Fe and B as the main components and therefore, the magnets of this type are collectively called an Nd—Fe—B type or R-T-B type magnet. In an R-T-B type magnet, R is primarily Nd with a part being replaced by another rare earth element such as Pr, Dy and Tb, or, more generally, R is at least one member selected from rare earth elements including Y; T is Fe with a part being replaced by a transition metal such as Co and Ni; and B is boron and may be partially replaced by C or N. Also, in R-T-B type magnets, one species or a combination of a plurality of species selected from Cu, Al, Ti, V, Cr, Ga, Mn, Nb, Ta, Mo, W, Ca, Sn, Zr, Hf and the like may be added as an additive element.

The R-T-B type alloy which can be used in an R-T-B type magnet is an alloy where a ferromagnetic $R_2T_{14}B$ phase contributing to the magnetization activity is the main phase and coexists with a nonmagnetic, rare earth element-enriched and low-melting point R-rich phase. This alloy is an active metal and therefore, generally melted or cast in vacuum or in an inert gas. From the cast R-T-B type alloy ingot, a sintered magnet is usually produced by a powder metallurgy process as follows. The alloy ingot is ground into an alloy powder of about 3 μm (as measured by FSSS (Fisher sub-sieve sizer)), press-shaped in a magnetic field, sintered at a high temperature of about 1,000 to 1,100° C. in a sintering furnace, then subjected to, if desired, heat treatment and machining, and further plated for enhancing the corrosion resistance, thereby completing a sintered magnet.

In the R-T-B type sintered magnet, the R-rich phase plays the following important roles:

1) becoming a liquid phase at the sintering by virtue of a low melting point and thereby contributing to high densification of the magnet and in turn, enhancement of the magnetization;

2) eliminating unevenness on the grain boundary and thereby yielding reduction in the nucleation site of the reversed magnetic domain and increase in the coercive force; and 3) magnetically isolating the main phase and thereby increasing the coercive force.

Accordingly, if the R-rich phase in the shaped magnet is in a poorly dispersed state, it incurs local failure of sintering or reduction of magnetism. Therefore, it is important that the R-rich phase is uniformly dispersed in the shaped magnet. Here, the R-rich phase distribution is greatly affected by the texture of the raw material R-T-B type alloy.

Another problem encountered in casting an R-T-B type alloy is production of α-Fe in the cast alloy. The α-Fe has deformability and remains in the grinder without being ground, and this not only decreases the grinding efficiency at the grinding of alloy but also affects the compositional fluctuation or particle size distribution. If α-Fe still remains in the magnet after sintering, reduction in the magnetic characteristics of the magnet results. Accordingly, α-Fe has been dealt with as a material which should be eliminated from the raw material alloy as much as possible. For this purpose, an alloy has been heretofore subjected to a homogenization treatment at a high temperature for a long time to eliminate α-Fe. When the amount of α-Fe in the raw material alloy is small, this may be removed by a homogenization heat treatment. However, α-Fe is present as a peritectic nucleus and therefore, its elimination requires solid phase diffusion for a long time. In the case of an ingot having a thickness of several cm and a rare earth content of 33% or less, elimination of α-Fe is practically impossible.

In order to solve the problem that α-Fe is produced in the R-T-B type alloy, a strip casting method (simply referred to as an "SC method") of casting an alloy ingot at a higher cooling rate has been developed, and this method is being used in actual processes.

The SC method is a method of solidifying an alloy through rapid cooling, where a molten alloy is cast on a copper roll of which the inside is water-cooled, and a flake of 0.1 to 1 mm is produced. In the SC method, the molten alloy is supercooled to the temperature where the main $R_2T_{14}B$ phase is produced, so that an $R_2T_{14}B$ phase can be produced directly from a molten alloy and the precipitation of α-Fe can be suppressed. Furthermore, in the SC method, the alloy comes to have a fine crystal texture, so that an alloy having a texture allowing for fine dispersion of an R-rich phase can be produced. The R-rich phase expands by reacting with hydrogen in a hydrogen atmosphere and becomes a brittle hydride. By utilizing this property, fine cracking commensurate with the dispersion degree of the R-rich phase can be introduced. When an alloy is pulverized through this hydrogenation step, a large amount of fine cracks produced by the hydrogenation trigger breakage of the alloy and therefore, very good grindability is attained. The internal R-rich phase in the alloy produced by the SC method is thus finely dispersed, and this leads to good dispersibility of the R-rich phase also in the magnet after grinding and sintering, thereby succeeding in enhancing the magnetic characteristics of the magnet (see, for example, Patent Document 1).

The alloy flake produced by the SC method is excellent also in terms of texture homogeneity. The texture homogeneity can be compared by the crystal grain diameter or the dispersed state of R-rich phase. In the case of an alloy flake produced by the SC method, a chill crystal is sometimes generated on the casting roll side of the alloy flake (hereinafter referred to as a "mold face side"), but an appropriately fine homogeneous texture yielded by the solidification through rapid cooling can be obtained as a whole.

As described above, in the R-T-B type alloy produced by the SC method, the R-rich phase is finely dispersed and the precipitation of α-Fe is also suppressed, so that in the production of a sintered magnet, the homogeneity of the R-rich phase in the final magnet can be increased and the adverse effect of α-Fe on the grinding and magnetism can be prevented. In this way, the R-T-B type alloy ingot produced by the SC method has an excellent texture for the production of a sintered magnet. However, along with enhancement of characteristics of the magnet, demands for high-level control of the raw material alloy texture, particularly, the presence state of the R-rich phase, are increasing.

The present inventors have previously made studies on the relationship between the texture of the cast-produced R-T-B type alloy and the behavior at the hydrogen cracking or pulverization and found that, in order to control the particle size of the alloy powder for a sintered magnet, the control of the dispersed state of R-rich phase is important (see, for example, Patent Document 2). Also, it has been found that fine division readily occurs in the region where the R-rich phase produced on the mold face side in the alloy (fine R-rich phase region) is extremely finely dispersed, as a result, the grinding stability of the alloy is deteriorated and at the same time, the particle size distribution of the powder is broadened. This finding leads to an understanding that reduction of the fine R-rich phase region is necessary for the enhancement of characteristics of the magnet.

However, even in the R-T-B type alloy disclosed in Patent Document 2, more enhancement of the magnetic characteristics is required.

Patent Document 1: JP-A-5-222488 (the term "JP-A" as used herein means an "unexamined published Japanese patent application")

Patent Document 2: JP-A-2003-188006

SUMMARY OF THE INVENTION

Under these circumstances, the present invention has been made and an object of the present invention is to provide an R-T-B type alloy as a raw material for a rare earth-based permanent magnet having excellent magnetic characteristics.

The present inventors have particularly observed the cross-sectional texture of alloy flakes which are cast and solidified under various conditions, and found that there is a relationship between the precipitated state of 2-17 phase and the magnetic characteristics and when a fine 2-17 phase ($R_2T_{17}$ phase) is precipitated in the alloy, the magnetic characteristics can be enhanced.

Also, the present inventors have confirmed the fact that when a sintered magnet is produced from an alloy allowing for the presence of a fine $R_2T_{17}$ phase or an alloy prepared by controlling the cooling rate on the casting roll or the temperature on separating from the casting roll in the SC method, the coercive force thereof is stably increased and excellent magnetic characteristics are obtained. The present invention has been accomplished based on these findings.

That is, the present invention provides the following inventions.

(1) An R-T-B type alloy (wherein R is at least one member selected from rare earth elements, T is a transition metal comprising Fe, and B comprises boron) which is a raw material for use in a rare earth-based permanent magnet, comprising a region containing an $R_2T_{17}$ phase having an average grain diameter of 3 μm or less in a short axis direction, wherein the volume percentage of the region containing the $R_2T_{17}$ phase having an average grain diameter of 3 μm or less in the short axis direction is from 0.5 to 10%.

(2) The R-T-B type alloy as described in (1), further comprising a region allowing for coexistence of the $R_2T_{17}$ phase having an average grain diameter of 3 μm or less in the short axis direction and an R-rich phase having an average grain diameter of 3 μm or less in the short axis direction, wherein the volume percentage of the region allowing for coexistence of the $R_2T_{17}$ phase having an average grain diameter of 3 μm or less in the short axis direction and the R-rich phase having an average grain diameter of 3 μm or less in the short axis direction is from 0.5 to 10%.

(3) The R-T-B type alloy as described in (1) or (2), further comprising a region containing an $R_2T_{17}$ phase having an average grain diameter of 10 μm or more in the short axis direction, wherein the volume percentage of the region containing the $R_2T_{17}$ phase having an average grain diameter of 10 μm or more in the short axis direction is 10% or less.

(4) The R-T-B type alloy as described in any one of (1) to (3), further comprising a region containing an $R_2T_{17}$ phase having an average grain diameter of 5 μm or more in the short axis direction, wherein the volume percentage of the region containing the $R_2T_{17}$ phase having an average grain diameter of 5 μm or more in the short axis direction is 10% or less.

(5) The R-T-B type alloy as described in any one of (1) to (4), wherein the $R_2T_{17}$ phase is a non-equilibrium phase.

(6) The R-T-B type alloy as described in any one of (1) to (5), which is a flake having an average thickness of 0.1 to 1 mm produced by a strip casting method.

(7) A method for producing an R-T-B type alloy flake by a strip casting method, comprising setting an average thickness of the flake to be from 0.1 to 1 mm, and supplying molten alloy to a casting roll at an average rate of 10 g/sec or more per 1-cm width.

(8) The method for producing an R-T-B type alloy flake as described in (7), wherein R-T-B type alloy cools on the casting roll at an average rate of from 500 to 3,000° C./sec.

(9) The method for producing an R-T-B type alloy flake as described in (7) or (8), wherein R-T-B type alloy, on separating from the casting roll, has an average temperature of from 100 to 400° C. lower than a solidification temperature of an $R_2T_{14}B$ phase in an equilibrium state of the R-T-B type alloy.

(10) An R-T-B type alloy produced by the production method of an R-T-B type alloy flake described in any one of (7) to (9).

(11) A fine powder for an R-T-B type rare earth permanent magnet, produced from the R-T-B type alloy described in any one of (1) to (6) and (10).

(12) An R-T-B type rare earth permanent magnet produced from the fine powder for an R-T-B type rare earth permanent magnet described in (11).

As used herein, the term "rare earth elements" is defined as including scandium (Sc), yttrium (Y), and the lanthanide series (atomic numbers 57 through 71), i.e., lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu). Also, as stated above, T is a transition metal comprising Fe. In certain embodiments, T is Fe with a part being replaced by one or more transition metals such as, for example, Co or Ni, so long as a majority of T is Fe. For example, T may comprise Fe in 80 mass % or more. Further, as stated above, B comprises boron. In certain embodiments, B is boron with a part being replaced by, for example, C or N, so long as a majority of B is boron. For example, B may comprise boron in 80 mass % or more.

In the R-T-B type alloy of the present invention, the volume percentage of a region containing an $R_2T_{17}$ phase having an average grain diameter of 3 μm or less in the short axis direction is 0.5 to 10%. Accordingly, a rare earth permanent magnet having a high coercive force and excellent magnetic characteristics can be realized.

Also, in the production method of an R-T-B type alloy flake, the alloy flake is produced by the SC method, and not only is the average thickness of the flake set to from 0.1 to 1 mm, but also the average molten alloy supply rate to the casting roll is set to 10 g/sec or more per 1-cm width. Accordingly, an R-T-B type alloy having a high coercive force can be obtained.

Figure 3:
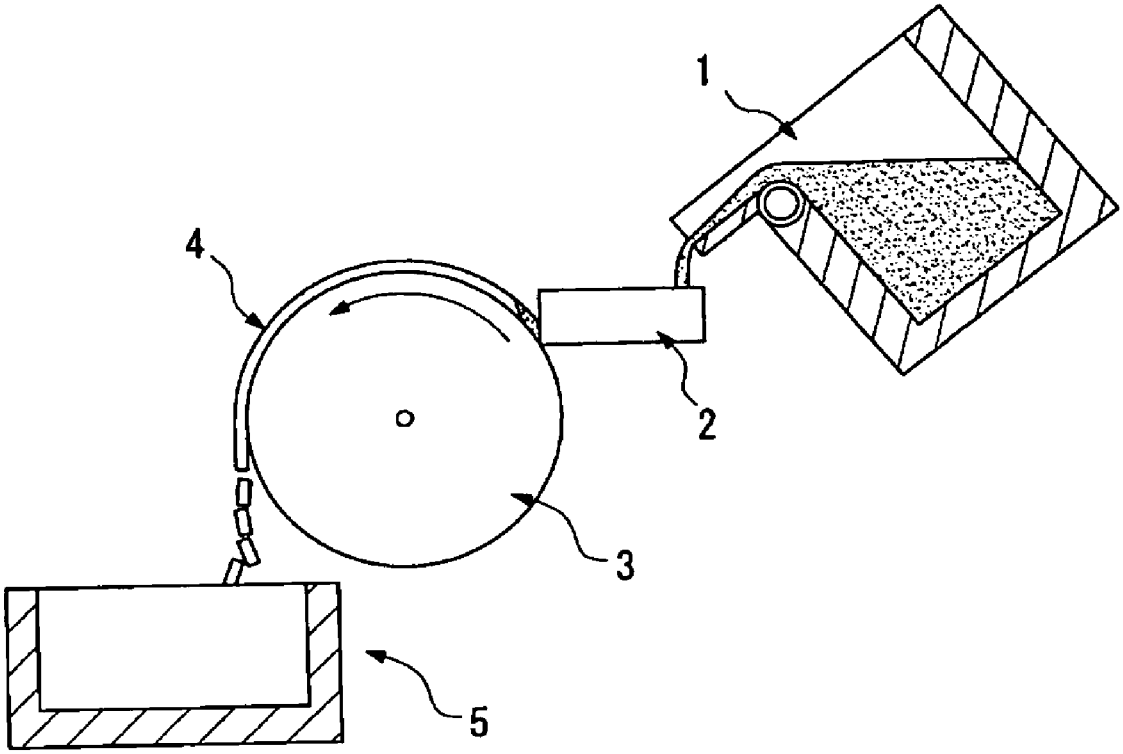
FIG. 3 is a schematic view of the apparatus for casting by the SC method.

Description of Reference Numerals (FIG. 3)

1 Refractory crucible

2 Tundish

3 Casting roll

4 Alloy

5 Collection container

DETAILED DESCRIPTION OF THE INVENTION

Figure 1:
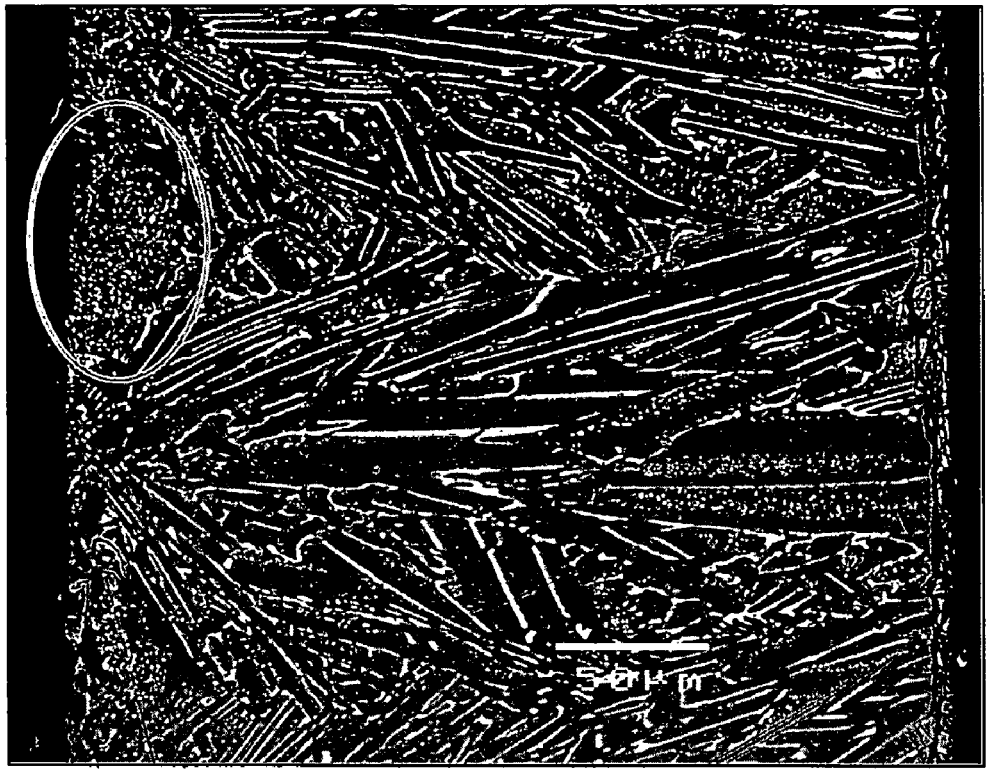
FIG. 1 is a photograph showing one example of the R-T-B type alloy of the present invention. The photograph is taken when the cross-section of the R-T-B type alloy flake is observed by a scanning electron microscope (SEM).

The R-T-B type alloy shown in FIG. 1 is produced by an SC method. This R-T-B type composition comprising, in terms of weight ratio, 22% of Nd, 9% of Dy, 0.95% of B, 1% of Co, 0.3% of Al and 0.1% of Cu, with the balance being Fe. In the composition according to the normal SC method involving large supercooling, an $R_2T_{17}$ phase is not precipitated and, even in an equilibrium state at an ordinary temperature, an $R_2T_{17}$ phase is not stably present at a temperature of 1,170° C. or less, which is the melting point of the $R_2T_{14}B$ phase. In FIG. 1, the R-rich phase is indicated by a white color and the $R_2T_{17}$ phase is indicated by a slightly darker color than the main $R_2T_{14}B$ phase.

As shown in FIG. 1, the R-T-B type alloy comprises a columnar crystal which is an $R_2T_{14}B$ phase, and an R-rich phase extending in the long axis direction of the columnar crystal. The $R_2T_{14}B$ phase mainly comprises a columnar crystal and partially comprises an equi-axed crystal, and the average crystal grain diameter thereof in the short axis direction is from 10to 50 μm. In the $R_2T_{14}B$ phase, a linear R-rich phase extending along the long axis direction of the columnar crystal or a particulated or partially broken R-rich phase is present at the gain boundary and within the grain. The average distance between R-rich phases present at the grain boundary and within the grain of the $R_2T_{14}B$ phase is from 3 to 10 μm. Also, as shown in FIG. 1, a region allowing for the coexistence of a fine $R_2T_{17}$ phase and an R-rich phase is present in the R-T-B type alloy, with each phase occupying an area percentage (volume percentage) of about 3%.

(1) $R_2T_{17}$ Phase

In the R-T-B type alloy shown in FIG. 1, the $R_2T_{17}$ phase is an intermetallic compound not having a composition width stably present from the ordinary temperature to high temperature region in the binary phase diagram of a rare earth-iron system. This phase is a soft magnetic phase with in-plane anisotropy at an ordinary temperature and when present in an R-T-B type sintered magnet, functions as a nucleation site of the reversed magnetic domain to cause reduction in the coercive force. However, even if a small amount of an $R_2T_{17}$ phase is present in the raw material alloy, this phase disappears in the sintering process and becomes harmless in many cases. Furthermore, the $R_2T_{17}$ phase is an intermetallic compound having no ductility and therefore, scarcely affects the grinding behavior in the magnet production step.

When the proportion of the heavy rare earth such as Dy and Tb is increased, the $R_2T_{17}$ phase precipitates as a primary crystal instead of α-Fe. This is magnetically soft but, unlike α-Fe, its effect on the grinding behavior is small as described above and in the SC method, the production thereof can be prevented similarly to α-Fe by the large supercooling.

(2) Crystal Grain Diameter of $R_2T_{17}$ Phase

Figure 2:
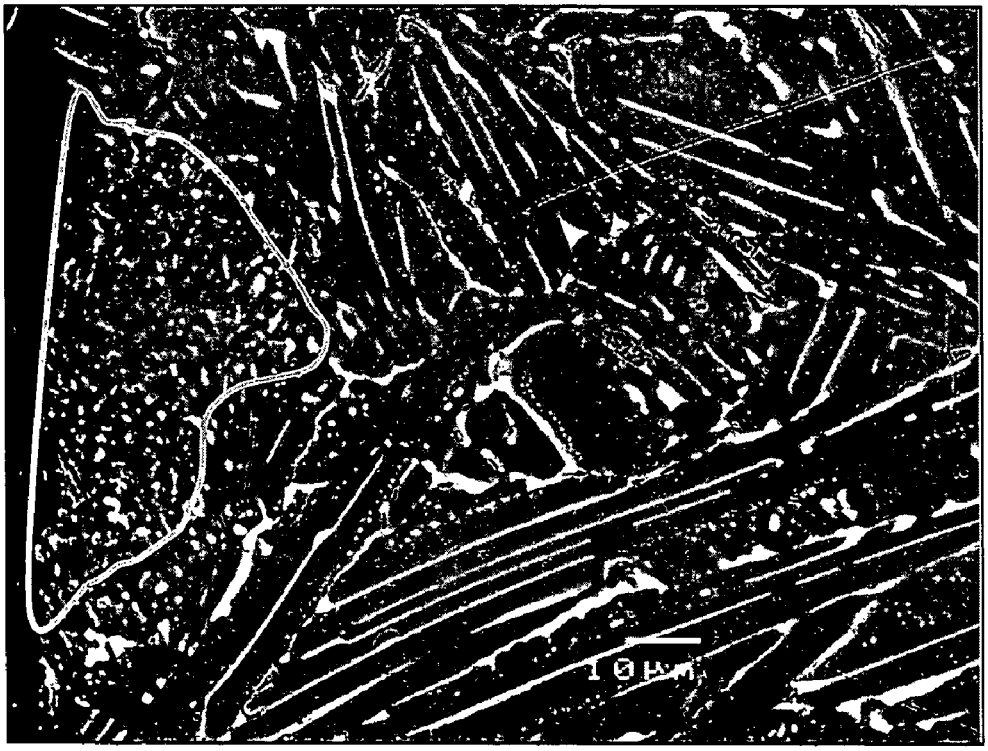
FIG. 2 is an enlarged photograph of the photograph shown in FIG. 1.

FIG. 2 is an enlarged photograph of the photograph shown in FIG. 1, and this photograph shows the region encircled with a white line in FIG. 1 and the peripheral region thereof. In FIG. 2, the region encircled with a white line indicates the region where the $R_2T_{17}$ phase is precipitated.

In the R-T-B type alloy, the average crystal grain diameter in the short axis direction of the $R_2T_{17}$ phase is preferably smaller. The average crystal grain diameter is approximately from 1 to 2 μm in the R-T-B type alloy shown in FIG. 1. As described above, when the crystal grain diameter of the $R_2T_{17}$ phase becomes large, the phase can hardly disappear at the sintering and, if it remains in the sintered body, the remaining phase incurs deterioration of the magnetic characteristics. This phase may be caused to disappear by increasing the sintering temperature or sintering time, but the main phase crystal grain is also coarsened to give rise to a decrease in the coercive force. By controlling the average crystal grain diameter in the short axis direction of the $R_2T_{17}$ phase to 3 μm or less, the effects of the present invention can be best brought out.

The adverse effect of the coarse $R_2T_{17}$ phase appears as the decrease in the orientation degree, in addition to the possibility of remaining in the sintered body or the reduction in the coercive force or squareness resulting from increase of the sintering temperature or time. Two causes are considered for the decrease in the orientation degree. A first cause is the in-plane anisotropy of the $R_2T_{17}$ phase. This phase differs also in the magnetization from the $R_2T_{14}B$ phase and therefore, may affect the orientation behavior of the $R_2T_{14}B$ phase during shaping in a magnetic field. As for the second cause, it is considered that a small $R_2T_{17}$ phase coalesces with the adjacent $R_2T_{14}B$ phase or converts into a liquid phase, however, when the $R_2T_{17}$ phase becomes large to an extent of up to the grain size of the main $R_2T_{14}B$ phase, the disappearance takes time and until reaching the disappearance, the phase reacts with a B-rich phase or the like in the neighborhood to produce and grow an $R_2T_{14}B$ phase nucleus. Here, the newly nucleated and grown $R_2T_{14}B$ phase has a random crystal orientation and therefore, the orientation degree as a whole decreases.

(3) Volume Percentage of $R_2T_{17}$ Phase-Containing Region

In the present invention, a region where, as shown in FIG. 2, an $R_2T_{17}$ phase is precipitated, is defined as an "$R_2T_{17}$ phase-containing region." This region can be easily distinguished from the peripheral alloy texture portion primarily comprising a main phase of columnar crystal and an R-rich phase extending in the long axis direction of the columnar crystal.

Particularly, when the average grain diameter in the short axis direction of the $R_2T_{17}$ phase is 3 μm or less, the above-described effect of improving the sinterability and enhancing the magnetic characteristics is best obtained. The volume percentage of the phase is preferably from 0.5 to 10%. If the volume percentage of the $R_2T_{17}$ phase having an average grain diameter of 3 μm or less in the short axis direction is less than 0.5%, the effect of improving the sinterability and enhancing the magnetic characteristics may decrease, whereas if the volume percentage of the $R_2T_{17}$ phase having an average grain diameter of 3 μm or less in the short axis direction exceeds 10%, the composition or particle size at the grinding may greatly fluctuate to cause large fluctuation of magnetic characteristics and also the magnetization may decrease due to reduction in the orientation degree. The volume percentage of the $R_2T_{17}$ phase having an average grain diameter of 3 μm or less in the short axis direction is more preferably from 1 to 5%. However, if the average crystal grain diameter in the short axis direction of the $R_2T_{17}$ phase exceeds 5 μm, the effect of precipitating an $R_2T_{17}$ phase may become poor and if the volume percentage of such an $R_2T_{17}$ phase-containing region exceeds 10%, the magnetic characteristics may greatly fluctuate. Also, if the average grain diameter in the short axis direction of the $R_2T_{17}$ phase is 10 μm or more and the volume percentage of the phase is 10% or more, the magnetic characteristics may deteriorate. The volume percentage of the region containing an $R_2T_{17}$ phase having an average grain diameter of 10 μm or more in the short axis direction is more preferably 5% or less.

(4) Stability of $R_2T_{17}$ Phase In a preferred embodiment of the present invention, the $R_2T_{17}$ phase present in the R-T-B type alloy exists as a non-equilibrium phase (metastable phase). The precipitate present as a metastable phase, not limited only to the $R_2T_{17}$ phase constituting the R-T-B type alloy of the present invention, is in an energetically high state and therefore, disappears in a high-temperature region where diffusion satisfactorily functions, for example, at about ½ of the decomposition temperature shown by the absolute temperature of the compound. The time required for the $R_2T_{17}$ phase present as a non-equilibrium phase to disappear varies depending on the temperature or the size of $R_2T_{17}$ phase, but the disappearance is easily attained as compared with the $R_2T_{17}$ phase present in an equilibrium state and in a magnet production process, the phase disappears within a general sintering time of several hours or less.

(5) R-Rich Phase

In a preferred embodiment of the present invention, as shown in FIG. 2, an R-rich phase having almost the same size is present together in the $R_2T_{17}$ phase precipitation site of the R-T-B type alloy. The R-rich phase expands by absorbing hydrogen to become brittle in the hydrogen cracking step before pulverization and becomes a starting point for fine cracking. By virtue of the coexistence of an R-rich phase, the $R_2T_{17}$ phase-containing region is ground more finely than the $R_2T_{14}B$ phase and the effect of fine $R_2T_{17}$ phase is more enhanced. Furthermore, good dispersibility of the R-rich phase is obtained and the sinterability is improved. However, if the average grain diameter in the short axis direction of the R-rich phase is increased to about 10 μm, the proportion of fine powder comprising only an R-rich phase may increase and the homogeneity in the powder compact may decrease, giving rise to worsened sinterability. The homogeneity of the R-rich phase in the sintered body may also decrease and therefore, the coercive force may be decreased. Furthermore, the hydrogenated R-rich phase is more brittle than the main phase and finely divided in a short time at the initial stage of grinding to increase the fluctuation of composition or particle size at the grinding, and this gives rise to fluctuation of characteristics. Accordingly, the average grain diameter in the short axis direction of the R-rich phase is preferably 3 μm or less.

(6) Strip Casting Method (SC method)

The R-T-B type alloy of the present invention shown in FIG. 1 is a flake produced by the strip casting method. For example, the R-T-B type alloy of the present invention can be cast-produced by the following SC method.

FIG. 3 is a schematic view showing the apparatus for casting by the SC method. Usually, an R-T-B type alloy is melted by using a refractory crucible 1 in a vacuum or inert gas atmosphere because of its active property. The molten alloy after melting the R-T-B type alloy is kept at 1,300 to 1,500° C. for a predetermined time and then supplied to a rotating roll 3 for casting (casting roll) with the inside being water-cooled, through a tundish 2 in which, if desired, a rectification mechanism or a slug removal mechanism is provided. The supply rate of the molten alloy and the rotation velocity of the casting roll are controlled according to the desired alloy thickness. In general, the rotation number of the casting roll is approximately from 0.5 to 3 m/s in terms of the peripheral velocity. The material of the casting roll is suitably copper or a copper alloy because of good heat conductivity and easy availability. Depending on the material of the casting roll or the surface state of the casting roll, a metal readily adheres to the casting roll surface. Therefore, if desired, a cleaning device is provided, whereby the quality of the cast-produced R-T-B type alloy is stabilized. The alloy 4 solidified on the casting roll is separated from the roll on the side opposite the tundish and recovered by a collection container 5. It is disclosed in JP-A-10-36949 that the texture state of the R-rich phase can be controlled by providing a heating and cooling mechanism in the collection container. In the present invention, in order to control the dispersed state of the R-rich phase, the cooling and thermal insulation after separation from the roll may be divided into several steps and thereby controlled. More specifically, for example, a heating and cooling mechanism is provided before finally collecting the alloy by the collection container and the alloy is heated, thermally insulated and cooled, whereby the size and homogeneity of the alloy texture, the particle size distribution of the fine particle after grinding, the supply to the metal mold, the bulk density, the adjustment of percentage shrinkage at sintering, and the magnetic characteristics can be improved.

(7) Thickness of Alloy

The R-T-B type alloy of the present invention is preferably a flake having an average thickness of 0.1 to 1 mm. If the average thickness of the flake is less than 0.1 mm, the solidification rate may be excessively increased and the R-rich phase may be too finely dispersed, whereas if the average thickness of the flake exceeds 1 mm, the solidification rate may decrease and this may incur reduction in the dispersibility of the R-rich phase, precipitation of α-Fe, coarsening of the $R_2T_{17}$ phase, or the like.

(8) Average Molten Metal Supply Rate to Casting Roll

The average molten alloy supply rate to the casting roll is 10 g/sec or more, preferably 20 g/sec or more, more preferably 25 g/sec or more, per 1-cm width, and still more preferably 100 g/sec or less per 1-cm width. If the molten alloy supply rate is less than 10 g/sec, the molten alloy may not be thinly wetted and spread on the roll and instead may shrink because of the viscosity of the molten alloy itself or wettability to the casting roll surface and fluctuation of the alloy quality may be brought about, whereas if the average molten alloy supply rate to the casting roll exceeds 100 g/sec per 1-cm width, cooling on the casting roll may be insufficient and may cause coarsening of the texture, precipitation of α-Fe, or the like. The supply rate can be controlled to a certain extent by providing a rectification mechanism in the tundish.

In the present invention, it has been confirmed that by increasing the supply rate to be higher than the minimum molten alloy supply rate necessary for causing the molten alloy to be stably and thinly wetted and spread on the roll surface, an alloy having an objective $R_2T_{17}$ phase-containing region can be easily produced.

(9) Average Cooling Rate of R-T-B Type Alloy on Casting Roll

This is a value obtained by dividing the difference between the temperature immediately before contact of the molten alloy with the casting roll and the temperature on separating from the casting roll by the time for which the molten alloy is contacted with the casting roll. The average cooling rate of the R-T-B type alloy on the casting roll is preferably from 500 to 3,000° C./sec. If the average cooling rate is less than 500° C./sec, precipitation of α-Fe or texture coarsening of the R-rich phase, $R_2T_{17}$ phase or the like may occur due to an insufficient cooling rate, whereas if the average cooling rate exceeds 3,000° C./sec, the supercooling may become too large and the production of the $R_2T_{17}$ phase-containing region as a characteristic feature of the present invention may decrease.

(10) Average Temperature of R-T-B Type Alloy on Separating from Casting Roll

The average temperature of the R-T-B type alloy on separating from the casting roll subtly varies due to fine difference in the degree of contact with the casting roll, fluctuation of the thickness, or the like. The average temperature of the alloy on separating from the casting roll can be obtained, for example, by scanning the alloy surface in the width direction by a radiation thermometer from start to finish of the casting, thereby measuring the temperature, and averaging the measured values.

The average temperature of the alloy on separating from the casting roll is preferably 100 to 400° C. lower, more preferably 100 to 300° C. lower, than the solidification temperature of the $R_2T_{14}B$ phase in an equilibrium state of the molten R-T-B type alloy. The melting temperature of the $R_2T_{14}B$ phase is acknowledged to be 1,150° C. in the Nd—Fe—B ternary system but varies according to the substitution of Nd by other rare earth elements, the substitution of Fe by other transition elements, and the kind and amount added of any additive elements. If the difference between the average temperature of the R-T-B type alloy on separating from the casting roll and the solidification temperature of the $R_2T_{14}B$ phase in an equilibrium state of the R-T-B type alloy is less than 100° C., this may correspond to an insufficient cooling rate, whereas if this difference exceeds 400° C., the supercooling of molten alloy may become excessively large due to a too high cooling rate. The degree of supercooling of the molten alloy is not uniform in the alloy but varies according to the degree of contact with the casting roll or the distance from the contact part with the casting roll.

As described above, the alloy temperature on separating from the casting roll varies also within the same casting step (tap) and if the variation width is large, this may bring about fluctuation of the texture or quality. Therefore, the variation width of temperature within the tap is suitably smaller than 200° C., preferably 100° C. or less, more preferably 50° C., still more preferably 20° C.

If the average temperature of the R-T-B type alloy on separating from the casting roll is 300° C. or more lower than the solidification of the $R_2T_{14}B$ phase in an equilibrium state of the molten alloy composition, the amount of the fine $R_2T_{17}$ phase precipitated may decrease and the effect of improving magnetic characteristics may become poor. This infers that precipitation of the $R_2T_{17}$ phase is generated in a portion where the supercooling degree is relatively small. Also, if the proportion of the heavy rare earth occupying in the rare earth is decreased, the amount of the $R_2T_{17}$ phase precipitated may also decrease and the presence of the phase cannot be confirmed, but the effect of enhancing the magnetic characteristics continues. This is considered to occur because the crystal defect of the $R_2T_{14}B$ phase decreases resulting from the appropriate reduction in the solidification rate and the stability is increased.

In the strip casting method, it is conventionally understood that as long as the crystal grain does not become excessively fine (i.e., cannot produce $R_2T_{17}$ phase), even if the cooling rate is high, there arises no problem. For example, in JP-A-08-269643, the cooling on the roll is called primary cooling and this reference indicates that cooling is preferably performed to a cast strip temperature of 700 to 1,000° C. at a cooling rate of $2\times10^3$ to $7\times10^{3}$° C./sec.

(11) R-T-B Type Rare Earth Permanent Magnet

For producing the R-T-B type rare earth permanent magnet of the present invention, a fine powder for R-T-B type rare earth permanent magnets is first produced from the R-T-B type alloy of the present invention. The fine powder for R-T-B type rare earth permanent magnets of the present invention is obtained, for example, by a method of performing hydrogen cracking of a flake comprising the R-T-B type alloy of the present invention and then pulverizing the flake by using a grinder such as jet mill. In the hydrogen cracking here, for example, a hydrogen absorption step of keeping the flake in a hydrogen atmosphere under a predetermined pressure is preferably performed in advance.

Then, the obtained fine powder for R-T-B type rare earth permanent magnets is, for example, press-shaped by a shaping machine or the like in a transverse magnetic field and sintered, whereby an R-T-B type rare earth permanent magnet is obtained.

In the R-T-B type alloy of the present invention, the fine $R_2T_{17}$ phase or the fine R-rich phase present together with the $R_2T_{17}$ phase swiftly converts into a liquid phase at the sintering, contributing to the enhancement of sinterability or dispersibility of the R-rich phase, so that a rare earth magnet having a high coercive force and excellent magnetic characteristics can be realized.

The $R_2T_{17}$ phase-containing alloy includes, for example, an alloy where an $R_2T_{17}$ phase-containing alloy powder by the SC method is mixed with an alloy powder having an $R_2T_{14}B$ phase as the main phase, which is obtained by the SC method, to increase the volume percentage of the $R_2T_{14}B$ phase (see, for example, JP-A-7-45413). However, as clearly seen from the claims and Examples, the $R_2T_{17}$ phase-containing alloy described in JP-A-7-45413 is formulated such that the $R_2T_{17}$ phase precipitates in an equilibrium state resulting from decrease in the B amount. In this case, the volume percentage of the $R_2T_{17}$ phase in the alloy increases and the crystal gain diameter of the $R_2T_{17}$ phase in the alloy also increases. Accordingly, in order to cause the $R_2T_{17}$ phase to disappear at the sintering, the particle size of the $R_2T_{17}$ phase-containing alloy powder needs to be made small. If the particle size is not made small, elevation of the sintering temperature or prolongation of the sintering time is required for obtaining satisfactory diffusion necessary for the disappearance of $R_2T_{17}$ phase, as a result, the texture of the sintered body is coarsened and reduction in the coercive force is caused. Also, it is easily presumed from the compositional formulation that the $R_2T_{17}$ phase described in JP-A-7-45413 is stably present from an ordinary temperature to the decomposition temperature thereof. Furthermore, JP-A-7-45413 indicates that the addition of the $R_2T_{17}$ phase brings about increase of the liquid phase, but is silent on the discussion from the kinetic aspect until reaching the liquid phase.

On the other hand, as described above, the $R_2T_{17}$ phase constituting the R-T-B type alloy of the present invention is precipitated as a non-equilibrium phase. The $R_2T_{17}$ phase present as a non-equilibrium phase readily disappears as compared with the $R_2T_{17}$ phase present in an equilibrium state and disappears within a sintering time which is generally several hours in the magnet production process.

Above, the method for producing an R-T-B type alloy having a composition allowing for precipitation of an $R_2T_{17}$ phase is described. However, the production method of an R-T-B type alloy flake of the present invention is not limited to the method for producing an R-T-B type alloy having a composition allowing for precipitation of an $R_2T_{17}$ phase. An R-T-B type alloy having a composition not allowing for precipitation of an $R_2T_{17}$ phase may be produced by the production method of an R-T-B type alloy flake of the present invention.

Also in this case, by producing an R-T-B type alloy according to the above-described production method of an R-T-B type alloy flake, as verified in the Examples below, an R-T-B type alloy having a high coercive force is obtained.

One presumable reason therefor is that when produced by the above-described production method of an R-T-B type alloy flake, the alloy is reduced in the crystal defect.

EXAMPLE 1

Raw materials of metallic neodymium, metallic dysprosium, ferroboron, cobalt, aluminum, copper and iron were provided to give an alloy composition comprising, in terms of weight ratio, 22% of Nd, 9% of Dy, 0.95% of B, 1% of Co, 0.3% of Al and 0.1% of Cu, with the balance being Fe. The raw materials were melted in an alumina crucible in an argon gas atmosphere at 1 atm by using a high-frequency melting furnace, and the molten alloy was cast by the SC method to produce an alloy flake.

The rotating roll for casting had a diameter of 600 mm and was made of an alloy obtained by mixing slight amounts of Cr and Zr with copper, and the inside thereof was water-cooled. The peripheral velocity of the roll at the casting was 1.3 m/sec, the average molten alloy supply rate to the casting roll was 28 g/sec per 1-cm width, and the average temperature of the alloy on separating from the casting roll was measured by a radiation thermometer and found to be 890° C. In the measured values, the difference between the maximum temperature and the minimum temperature was 35° C. Since the melting point of the $R_2T_{14}B$ phase of this alloy is about 1,170° C., the difference from the average separation temperature is 280° C. Also, the average cooling rate of the R-T-B type alloy on the casting roll was 980° C./sec and the average thickness was 0.29 mm. The recovery container for housing alloy flakes separated from the roll had a partition plate through which a cooling Ar gas was flowed. The production conditions of the alloy flake are shown in Table 1.

TABLE 1

| | Supply Rate (g) | Cooling Rate (° C./sec) | Solidification Temperature (° C.) | Average Temperature Difference (° C.) | Average Thickness (mm) | Average Grain Diameter 1 (μm) | Volume Percentage 1 (%) | Average Grain Diameter 2 (μm) | Volume Percentage 2 (%) | Average Grain Diameter 3 (μm) | Volume Percentage 3 (%) |
|---|---|---|---|---|---|---|---|---|---|---|---|
| Example 1 | 28 | 980 | 1170 | 280 | 0.29 | 1.5 | 3 | — | none | 2.1 | |
| Example 2 | 28 | 1060 | 1140 | 290 | 0.29 | — | none | — | none | — | none |
| Comparative Example 1 | 13 | 920 | 1170 | 540 | 0.23 | — | none | — | none | — | none |
| Comparative Example 2 | 13 | 930 | 1140 | 520 | 0.23 | — | none | — | none | — | none |
| Comparative Example 3 | 70 | 290 | 1170 | 170 | 1.2 | — | none | 8 | 30 | — | none |

In Table 1, "Supply Rate" indicates the average molten alloy supply rate to the casting roll, and this is the amount supplied per 1-cm width per second; "Cooling Rate" indicates the average cooling rate of the R-T-B type alloy on the casting roll; "Solidification Temperature" is a solidification temperature (melting point) of the $R_2T_{14}B$ phase in an equilibrium state of the R-T-B type alloy; "Average Temperature Difference" indicates the temperature difference between the "Solidification Temperature" and the average temperature of the R-T-B type alloy on separating from the casting roll; and "Average Thickness" indicates an average thickness of flakes produced by the strip casting method.

Evaluation of Alloy Flake

10 Sheets of the obtained alloy flake was embedded and after polishing, a backscattered electron image (BEI) of each alloy flake was photographed at a magnification of 350 by a scanning electron microscope (SEM). The average crystal grain diameter in the short axis direction of each of the $R_2T_{17}$ phase and the R-rich phase in the $R_2T_{17}$ phase-containing region and the R-rich phase-containing region of the photograph taken was analyzed by an image analyzer. Furthermore, the photograph taken was cut into photographs of $R_2T_{17}$ phase-containing region and R-rich phase containing region, and the volume percentage was calculated from the weight ratio. Here, as for the $R_2T_{17}$ phase-containing region, the volume percentage was calculated for each of the $R_2T_{17}$ phases having an average grain diameter of 3 μm or less and an average grain diameter of 5 μm or more in the region. The average grain diameter and volume percentage of each texture of the alloy flake are shown in Table 1.

In Table 1, Average Grain Diameter 1 and Volume Percentage 1 indicate the average grain diameter of the $R_2T_{17}$ phase having an average grain diameter of 3 μm or less in the short axis direction and the volume percentage of the region containing the $R_2T_{17}$ phase; Average Grain Diameter 2 and Volume Percentage 2 indicate the average grain diameter of the region containing an $R_2T_{17}$ phase having an average grain diameter of 5 μm or more in the short axis direction and the volume percentage of the region containing the $R_2T_{17}$ phase; and Average Grain Diameter 3 and Volume Percentage 3 indicate the average grain diameter of the R-rich phase having an average grain diameter of 3 μm or less in the short axis direction present in the region containing an $R_2T_{17}$ phase having an average grain diameter of 3 μm or less in the short axis direction and the volume percentage of the region.

Furthermore, the obtained alloy flakes were heat-treated at 1,000° C. for 2 hours and a backscattered electron image (BEI) of each alloy flake was photographed at a magnification of 350 by a scanning electron microscope (SEM), as a result, complete disappearance of the $R_2T_{17}$ phase was confirmed. This reveals that the $R_2T_{17}$ phase in the alloy flake before heat treatment was a metastable phase. Incidentally, it is apparent from the compositional formulation that in the alloy composition of Example 1, the $R_2T_{17}$ phase is not stably present at 1,170° C. or less, which is the melting point of the $R_2T_{14}B$ phase.

COMPARATIVE EXAMPLE 1

Raw materials were blended to give the same composition as in Example 1, and melting and casting by the SC method were performed in the same manner as in Example 1. However, the peripheral velocity of the roll at the casting was 0.8 m/sec, the average molten alloy supply rate to the casting roll was 13.0 g/sec per 1-cm width, the average temperature of the alloy on separating from the casting roll, measured by a radiation thermometer, was 630° C., and the difference between the maximum temperature and the minimum temperature of the measured values was 160° C. Since the melting point of the $R_2T_{14}B$ phase of this alloy is about 1,170° C., the difference from the average separation temperature is 540° C. Also, the average cooling rate of the R-T-B type alloy on the casting roll was 920° C./sec and the average thickness was 0.23 mm.

The obtained alloy flakes were evaluated in the same manner as in Example 1, and the results are shown in Table 1. Incidentally, in Comparative Example 1, the $R_2T_{17}$ phase-containing region could not be confirmed.

EXAMPLE 2

Metallic neodymium, metallic praseodymium, ferroboron, cobalt, aluminum, copper and iron were blended to give an alloy composition comprising, in terms of weight ratio, 26.0% of Nd, 5.0% of Pr, 0.95% of B, 1.0% of Co, 0.3% of Al and 0.1% of Cu, with the balance being Fe. Melting and casting were performed by the SC method in the same manner as in Example 1. However, the peripheral velocity of the roll at the casting was 1.3 m/sec, the average molten alloy supply rate to the casting roll was 28 g/sec per 1-cm width, the average temperature of the alloy on separating from the casting roll, measured by a radiation thermometer, was 850° C., and the difference between the maximum temperature and the minimum temperature of the measured values was 20° C. Since the melting point of the $R_2T_{14}B$ phase of this alloy is about 1,140° C., the difference from the average separation temperature is 290° C. Also, the average cooling rate of the R-T-B type alloy on the casting roll was 1,060° C./sec and the average thickness was 0.29 mm.

The obtained alloy flakes were evaluated in the same manner as in Example 1, and the results are shown in Table 1. Incidentally, the composition of the R-T-B type alloy of Example 2 is formulated not to allow for precipitation of the $R_2T_{17}$ phase and in Example 2, the $R_2T_{17}$ phase-containing region could not be confirmed.

COMPARATIVE EXAMPLE 2

Raw materials were blended to give the same composition as in Example 1, and melting and casting by the SC method were performed in the same manner as in Example 1. However, the peripheral velocity of the roll at the casting was 0.8 m/sec, the average molten alloy supply rate to the casting roll was 13.0 g/sec per 1-cm width, the average temperature of the alloy on separating from the casting roll, measured by a radiation thermometer, was 620° C., and the difference between the maximum temperature and the minimum temperature of the measured values was 180° C. Since the melting point of the $R_2T_{14}B$ phase of this alloy is about 1,140° C., the difference from the average separation temperature is 520° C. Also, the average cooling rate of the R-T-B type alloy on the casting roll was 930° C./sec and the average thickness was 0.23 mm.

The obtained alloy flakes were evaluated in the same manner as in Example 1, and the results are shown in Table 1. Incidentally, in Comparative Example 2, the $R_2T_{17}$ phase-containing region could not be confirmed.

COMPARATIVE EXAMPLE 3

Raw materials were blended to give the same composition as in Example 1, and melting and casting by the SC method were performed in the same manner as in Example 1. However, the peripheral velocity of the roll at the casting was 0.8 m/sec, the average molten alloy supply rate to the casting roll was 70 g/sec per 1-cm width, the average temperature of the alloy on separating from the casting roll, measured by a radiation thermometer, was 1,000° C., and the difference between the maximum temperature and the minimum temperature of the measured values was 250° C. Since the melting point of the $R_2T_{14}B$ phase of this alloy is about 1,170° C., the difference from the average separation temperature is 170° C. Also, the average cooling rate of the R-T-B type alloy on the casting roll was 290° C./sec and the average thickness was 1.2 mm.

The obtained alloy flakes were evaluated in the same manner as in Example 1, and the results are shown in Table 1. In Comparative Example 3, the presence of a slight amount of the $R_2T_{17}$ phase-containing region was confirmed even after the alloy flake was heat-treated at 1,000° C. for 2 hours similarly to Example 1. This is caused because the grain size of the $R_2T_{17}$ phase present before heat treatment is large and a long time is necessary for the phase to disappear. Incidentally, in the composition of Comparative Example 3, similarly to Example 1, the $R_2T_{17}$ phase is not stably present at a temperature of 1,170° C. or less, which is the melting point of the $R_2T_{14}B$ phase.

Examples where a sintered magnet was produced are described below.

EXAMPLE 3

The alloy flake obtained in Example 1 was subjected to hydrogen cracking and pulverization by a jet mill. The conditions in the hydrogen absorption step as the pre-step of the hydrogen cracking step were a 100% hydrogen atmosphere, a pressure of 2 atm, and a holding time of 1 hour. The temperature of the metal strip at the initiation of a hydrogen absorption reaction was 25° C. The conditions in the dehydrogenation step as the post-step were an in-vacuum atmosphere of 0.133 hPa, 500° C. and a holding time of 1 hour. Subsequently, 0.07 mass % of a zinc stearate powder was added to the powder obtained above, and the resulting powder was thoroughly mixed by a V-type blender in a 100% nitrogen atmosphere and then pulverized by a jet mill. The atmosphere at the grinding was a nitrogen atmosphere having mixed therein 4,000 ppm of oxygen. Thereafter, the powder was again thoroughly mixed by a V-type blender in a 100% nitrogen atmosphere. The oxygen concentration in the obtained powder material was 2,500 ppm. Also, from the analysis of carbon concentration in this powder material, the zinc stearate powder mixed in the powder material was calculated as 0.05 mass %.

The obtained powder material was press-shaped by a shaping machine in a transverse magnetic field in a 100% nitrogen atmosphere. The shaping pressure was 0.8 t/cm$^2$ and the magnetic field in the die cavity was set to 15 kOe. The resulting powder compact was sintered by holding it in vacuum of $1.33\times10^{-5}$ hPa at 500° C. for 1 hour, then in vacuum of $1.33\times10^{-5}$ hPa at 800° C. for 2 hours, and further in vacuum of $1.33\times10^{-5}$ hPa at 1,030° C. for 2 hours. The sintering density was 7.7 g/cm$^3$ or more and this was a sufficiently large density. This sintered body was further heat-treated at 530° C. for 1 hour in an argon atmosphere to produce a sintered magnet.

The magnetic characteristics of this sintered body of Example 3 were measured by a direct current BH curve tracer, and the results are shown in Table 2.

TABLE 2

| | Br T | iHc kA/m | (BH)max kJ/m$^3$ | SQ (%) |
|---|---|---|---|---|
| Example 3 | 1.16 | 2680 | 260 | 91 |
| Example 4 | 1.45 | 1247 | 403 | 92 |
| Comparative Example 4 | 1.16 | 2551 | 259 | 91 |
| Comparative Example 5 | 1.45 | 1068 | 403 | 91 |
| Comparative Example 6 | 1.1 | 2425 | 234 | 90 |

In Table 2, "Br" indicates the residual magnetic flux density, "iHc" indicates the coercive force, "(BH)max" indicates the maximum magnetic energy product, and "SQ" indicates the squareness. As for the squareness, the value of an external magnetic field when the magnetization becomes 90% of the saturation magnetization is divided by iHc and the obtained value is expressed in %.

COMPARATIVE EXAMPLE 4

Using the alloy flake obtained in Comparative Example 1, a sintered magnet was produced by the same method as in Example 3. The magnetic characteristics of this sintered magnet of Comparative Example 4 were measured by a direct current BH curve tracer, and the results are shown in Table 2.

EXAMPLE 4

Using the alloy flake obtained in Example 2, a sintered magnet was produced by the same method as in Example 3. The magnetic characteristics of this sintered magnet of Example 4 were measured by a direct current BH curve tracer, and the results are shown in Table 2.

COMPARATIVE EXAMPLE 5

The alloy flake obtained in Comparative Example 2 was ground by the same method as in Example 3 to obtain a fine powder. The magnetic characteristics of the obtained sintered magnet of Comparative Example 5 were measured by a direct current BH curve tracer, and the results are shown in Table 2.

COMPARATIVE EXAMPLE 6

The alloy flake obtained in Comparative Example 3 was ground by the same method as in Example 3 to obtain a fine powder. The magnetic characteristics of the obtained sintered magnet of Comparative Example 6 were measured by a direct current BH curve tracer, and the results are shown in Table 2.

As seen from Table 2, in Comparative Example 4 where the $R_2T_{17}$ phase-containing region is not confirmed and the average temperature difference exceeds 300° C., the coercive force (iHc) is low as compared with Example 3 where the alloy is produced by the production method of an R-T-B type alloy flake of the present invention. The cause of this is presumed that the sinterability is improved by the $R_2T_{17}$ phase-containing region in the alloy of Example 1.

Also, in Comparative Example 6 using the alloy of Comparative Example 3 where the grain diameter and volume percentage of the $R_2T_{17}$ phase are large, the coercive force (iHc) and maximum magnetic energy product ((BH)max) are decreased as compared with Example 3.

Furthermore, in Example 4 using the alloy of Example 2 which has a composition containing no heavy rare earth and not allowing for precipitation of an $R_2T_{17}$ phase and is produced by the production method of an R-T-B type alloy flake of the present invention, the coercive force is large as compared with Comparative Example 5 where the average temperature difference exceeds 300° C. The cause of this is still being studied, but one presumable reason therefor is that by virtue of the low solidification rate, the number of crystal defects is smaller in the alloy of Example 2.

What is claimed is:

1. An R-T-B type alloy for use in a rare earth-based permanent magnet, comprising an $R_2T_{14}B$ phase as the main phase, and comprising a region containing an $R_2T_{17}$ phase having an average grain diameter of 3 μm or less in a short axis direction, wherein R is at least one member selected from rare earth elements, and R is at least one of Dy or Tb, T is a transition metal comprising Fe, and B comprises boron, and wherein the volume percentage of the region containing the $R_2T_{17}$ phase having an average grain diameter of 3 μm or less in the short axis direction is from 0.5 to 10% of the entire alloy.

2. The R-T-B type alloy as claimed in claim 1, further comprising a region allowing for coexistence of an $R_2T_{17}$ phase having an average grain diameter of 3 μm or less in the short axis direction and an R-rich phase having an average grain diameter of 3 μm or less in the short axis direction, wherein the volume percentage of the region allowing for coexistence of the $R_2T_{17}$ phase having an average grain diameter of 3 μm or less in the short axis direction and the R-rich phase having an average grain diameter of 3 μm or less in the short axis direction is from 0.5 to 10% of the entire alloy.

3. The R-T-B type alloy as claimed in claim 1, further comprising a region containing an $R_2T_{17}$ phase having an average grain diameter of 10 μm or more in the short axis direction, wherein the volume percentage of the region containing the $R_2T_{17}$ phase having an average grain diameter of 10 μm or more in the short axis direction is 10% or less of the entire alloy.

4. The R-T-B type alloy as claimed in claim 1, further comprising a region containing an $R_2T_{17}$ phase having an average grain diameter of 5 μm or more in the short axis direction, wherein the volume percentage of the region containing the $R_2T_{17}$ phase having an average grain diameter of 5 μm or more in the short axis direction is 10% or less of the entire alloy.

5. The R-T-B type alloy as claimed in claim 1, wherein the $R_2T_{17}$ phase is a non-equilibrium phase.

6. The R-T-B type alloy as claimed in claim 1, which is a flake having an average thickness of 0.1 to 1 mm produced by a strip casting method.

7. A fine powder for an R-T-B type rare earth permanent magnet, produced from the R-T-B type alloy claimed in claim 1.

8. An R-T-B type rare earth permanent magnet produced from the fine powder for an R-T-B type rare earth permanent magnet claimed in claim 7.

* * * * *